US008371059B1

(12) United States Patent
Tillinghast

(10) Patent No.: US 8,371,059 B1
(45) Date of Patent: Feb. 12, 2013

(54) AIMING POST LIGHT

(75) Inventor: Ralph C. Tillinghast, Hardwick, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 215 days.

(21) Appl. No.: 12/826,981

(22) Filed: Jun. 30, 2010

(51) Int. Cl.
*F21V 23/00* (2006.01)

(52) U.S. Cl. ..... 42/132; 362/84

(58) Field of Classification Search ..... 42/132; 362/84, 85, 276, 235, 183; 315/149, 156
See application file for complete search history.

(56) References Cited

U.S. PATENT DOCUMENTS

| | | | | | |
|---|---|---|---|---|---|
| 1,359,581 | A * | 11/1920 | Dodds | 375/352 |
| 3,421,013 | A * | 1/1969 | Angelari | 250/239 |
| 4,228,485 | A * | 10/1980 | Hubbard et al. | 362/191 |
| 4,290,095 | A * | 9/1981 | Schmidt | 362/191 |
| 4,346,329 | A * | 8/1982 | Schmidt | 315/51 |
| 5,540,719 | A * | 7/1996 | Covelli-Ingwell et al. | 606/234 |
| 6,153,985 | A * | 11/2000 | Grossman | 315/291 |
| 6,495,973 | B1 * | 12/2002 | Allen, Jr. | 315/302 |
| 7,828,453 | B2 * | 11/2010 | Tran et al. | 362/84 |
| 7,972,023 | B2 * | 7/2011 | Tran et al. | 362/84 |

* cited by examiner

*Primary Examiner* — Michael Carone
*Assistant Examiner* — Reginald Tillman, Jr.
(74) *Attorney, Agent, or Firm* — Michael C. Sachs

(57) ABSTRACT

An improved aiming post light configuration wherein a luminescent material in conjunction with an optical taper or other magnification structure is positioned within the body of the aiming post along with a recharge circuit which recharges the luminescent material periodically or when light output from the luminescent material falls below a predetermined threshold. Advantageously, the entire configuration may be integral to the aiming post itself.

6 Claims, 2 Drawing Sheets

AIMING POST LIGHT

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of artillery and mortars. More particularly, it pertains to an improved aiming post light for use with—for example—field mortar systems.

BACKGROUND OF THE DISCLOSURE

Aiming posts are structures that are placed into the ground and used as a sighting point in aligning a weapon for indirect fire missions. Aiming posts having attached lights and are placed forward of their guns at a distance—for example—50 to 100 meters. As may be appreciated, replacement of the posts, lights or batteries may be particularly hazardous when an enemy is nearby. Accordingly, an aiming post light exhibiting a long battery life while not exposing its position to the enemy would represent a significant advance in the art.

SUMMARY OF THE DISCLOSURE

Such an advance in the art is made according to an aspect of the present disclosure directed to an aiming post light configuration. Viewed from a first aspect, the present disclosure is directed to an aiming post light configuration employing a luminescent material. The configuration employs a fiber optic taper or an optical taper or other optical magnifier to produce a visible light spot from the luminescent material. Advantageously, the entire configuration may be integral to the aiming post itself.

Viewed from another aspect, the present disclosure is directed to an aiming post light configuration utilizing a "recharge" circuit which measures the light output from the luminescent material. When the measured output falls below a predetermined threshold, the circuit enables an LED or other light source to recharge the luminescent material. Once that material is recharged, the LED or other light source is turned off and the aiming post light output is produced by the luminescent material and enhanced by the effect of the optical taper or fiber optic taper. In this manner, significant battery life is achieved as the LED or other powered light source is operated a minimal amount of time—preferably only to perform the recharge. Still further, the use of the optical or fiber optic taper produces a visible light spot from a small amount of light emitted from the luminescent material which—at the same time—is generally visible only within a direct line of sight and not peripheral thereby minimizing its detection by any enemy.

BRIEF DESCRIPTION OF THE DRAWINGS

A more complete understanding of the present disclosure may be realized by reference to the accompanying drawings in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

Figure 1:
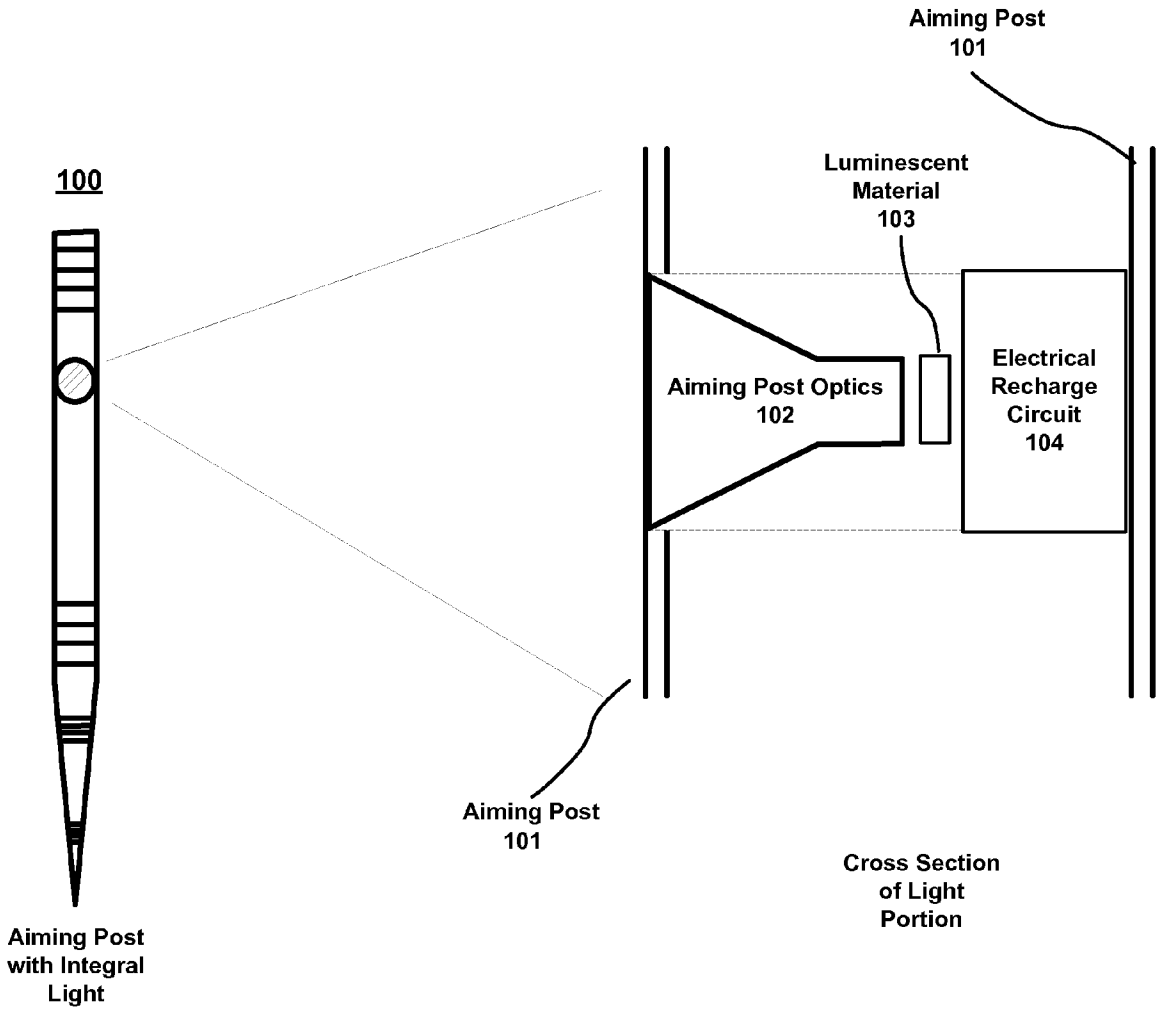
FIG. 1 is a schematic diagram showing an improved aiming post having an integral light according to an aspect of the present disclosure.

With reference now to FIG. 1, there is shown a schematic diagram of an aiming post configuration 100 according to an aspect of the present disclosure. As generally shown the configuration 100 includes an aiming post having an integral light as shown. Shown further in that FIG. 1, is a cross-sectional view of the light portion of the aiming post 100.

With reference to that cross-sectional view, it may be observed that positioned within the aiming post itself are a luminescent material 103 (e.g. Tritium or other materials) which produces light and aiming post optics 102 which receives light output from the luminescent material 103 at one end and outputs light at another end. As will be discussed in greater detail, the aiming post optics 102 in a preferred embodiment will enhance particular characteristics of the light output from the luminescent material 103 such that the overall utility and effectiveness of the aiming post is improved.

With continuing reference to that cross-sectional view an electrical recharge circuit 104 is employed and functions to monitor the light output from the luminescent material 103 and—if that light output falls below a predetermined threshold—will apply light to that material from—for example—an LED or other light source such that the luminescent material is recharged.

At this point it may be apparent to those skilled in the art that the aiming post optics 102 employed according to the present disclosure may be conveniently performed by an optical taper or a fiber optic taper. As may be appreciated by those skilled in the art, tapers—provide a method of magnifying or reducing an image with minimal distortion. Advantageously, tapers may be fabricated to a variety of specifications, and may be machined into configurations from round-to-round, square-to-square, round-to-square or rectangular. Sizes may be varied and typical magnification rations range up to 3:1. In one representative embodiment, a fiber optic taper optically transmits either a magnified or reduced image from its input surface to its output surface.

As part of the aiming post that is the subject of the instant disclosure, the aiming post optics 102 may comprise a taper and will therefore magnify light emitted from the luminescent material 103 and received at the small end of the taper.

While not specifically emphasized to this point, one advantage of an aiming post constructed according to the present disclosure is that the light generation may be completely contained within the aiming post itself. In this manner, the size of the light is kept relatively small, while providing some environmental protection to the light and convenient packaging.

Still further, the taper provides output light that is directional in nature. That is to say an observer of the light must be viewing the aiming post within a tight viewing angle. Consequently the aiming post may remain positioned, operational, yet undetected by an enemy that may be in its area.

Figure 2:
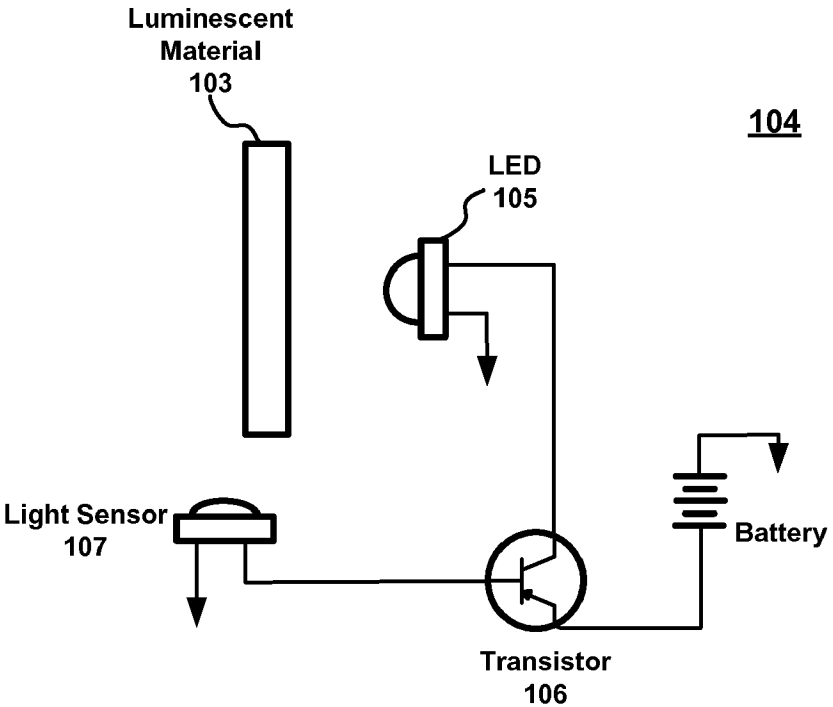
FIG. 2 is a schematic of an exemplary recharge circuit for the improved aiming post of FIG. 1.

Turning now to FIG. 2, a simple circuit schematic is shown according to an aspect of the present disclosure. More particularly, a light sensor 107 , a light source (i.e., LED) 105, a transistor 106 and a battery are shown in electrical communication with one another. Operationally, the light sensor 107 detects light output from the luminescent material 103 and when that output is below some predetermined threshold, then the battery operated recharging circuit will activate the LED 105 to recharge the luminescent material 103. In this manner a prolonged light output from the luminescent material may be realized while minimizing the battery drain thereby extending its operational lifetime.

As may be appreciated, the light sensor may advantageously be constructed from a variety of sensors including phototransistors or micro-electromechanical systems (MEMS).

At this point, while we have discussed and described the invention using some specific examples, those skilled in the art will recognize that our teachings are not so limited. For example, it is noted that while the continuous monitoring of the light output from the luminescent glow material is shown and described, it is noted that other recharge strategies may be employed as well. In particular, a scheme whereby the recharge light is activated according to some set schedule may be employed. For a example a timer could be added to the circuit to regulate the duration of time the LED is activated. Accordingly, the invention should be only limited by the scope of the claims attached hereto.

The invention claimed is:

1. An aiming post comprising:

a luminescent material connected to a light magnifying means to broadcast a secondary light directionally out from a location on said aiming post;

a light emitting diode device to output a first light, said light emitting diode device connected to shine said first light into said luminescent material to charge said luminescent material with said secondary light available to be broadcast from said luminescent material, whereas said secondary light depletes over time and diminishes, and whereas said aiming post further comprises a means for automatically recharging said secondary light in said luminescent material, said means for recharging comprising:

a battery having one of its terminals connected to a ground and a second terminal connected to the emitter of a p-n-p transistor;

said light emitting diode device further having two input terminals whereas one of its input terminals is connected to said ground and a second input terminal is connected to the collector of said p-n-p transistor;

a light sensor device connected to also receive some secondary light from said luminescent material, said light sensor device having one of its terminals connected to a ground and a second terminal connected to the base of said p-n-p transistor;

whereas, a diminution of light received in said light sensor device causes a diminution of potential outputted from said light sensor device to the base of said p-n-p transistor, and a diminution of potential received at the base of said p-n-p transistor causes a diminution of the bias on said p-n-p transistor, and a diminution of the bias on said p-n-p transistor permits potential from said battery to flow through said p-n-p transistor to increase at the collector terminal of said p-n-p transistor which in turn causes the light emitting diode device to increase its output of light, and whereas said increase of light output from said light emitting diode device will cause an increase of secondary light available to be broadcast from said luminescent material.

2. The aiming post of claim 1 wherein said light magnifying means comprise an optical taper device.

3. The aiming post of claim 1 wherein said light magnifying means comprise a fiber optical taper device.

4. The aiming post of claim 2 wherein said luminescent material, said optical taper and said means for recharging are all positioned within a hollow body of the aiming post.

5. The aiming post of claim 1 wherein said light sensor device is selected from the group of: phototransistors or MEMS microelectromechanical systems.

6. The aiming post of claim 4 wherein the aiming post is pushed into the ground and used as an aid on a weapon for indirect fire missions.

* * * * *